US008556395B2

(12) United States Patent
Hiratsuka et al.

(10) Patent No.: US 8,556,395 B2
(45) Date of Patent: Oct. 15, 2013

(54) LIQUID SUPPLY MECHANISM AND IMAGE FORMING APPARATUS

(75) Inventors: Masashi Hiratsuka, Kanagawa (JP); Masaki Kataoka, Kanagawa (JP); Jun Isozaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 11 days.

(21) Appl. No.: 13/298,573

(22) Filed: Nov. 17, 2011

(65) Prior Publication Data

US 2013/0002772 A1 Jan. 3, 2013

(30) Foreign Application Priority Data

Jun. 28, 2011 (JP) ..... 2011-143450

(51) Int. Cl.
*B41J 2/175* (2006.01)
*B41J 2/18* (2006.01)

(52) U.S. Cl.
USPC ..... 347/85; 347/89

(58) Field of Classification Search
USPC ..... 347/84, 85, 89
See application file for complete search history.

(56) References Cited

U.S. PATENT DOCUMENTS 4,680,696 A * 7/1987 Ebinuma et al. ..... 347/85
7,901,063 B2 * 3/2011 Wouters et al. ..... 347/89
8,100,500 B2 * 1/2012 Bansyo ..... 347/19
8,197,046 B2 * 6/2012 Asami ..... 347/89
8,205,973 B2 * 6/2012 Nitta et al. ..... 347/85
8,336,997 B2 * 12/2012 Katada et al. ..... 347/85
2002/0047882 A1 4/2002 Karlinski et al.
2009/0284563 A1 11/2009 Bansyo

FOREIGN PATENT DOCUMENTS

JP 2010-137397 6/2010
WO 2007/098524 9/2007

OTHER PUBLICATIONS

Extended European Search Report in EP 11190230 dated Oct. 15, 2012.

* cited by examiner

*Primary Examiner* — Anh T. N. Vo
(74) *Attorney, Agent, or Firm* — Fildes & Outland, P.C.

(57) ABSTRACT

A liquid supply mechanism includes: a supply pathway that supplies liquid to a plurality of ejection sections each ejecting the liquid from nozzles; a branching path that is branched off from the supply pathway and through which the liquid circulates; a buffer unit that is disposed in the branching path and that lessens pressure fluctuations occurred in the liquid in the branching path; and a changing unit that changes a pathway to the buffer unit so that the changing unit shuts the pathway to the buffer unit during maintenance for discharging the liquid from the nozzles of the ejection sections. The liquid discharged during the maintenance is greater in quantity than the liquid discharged during normal operation.

10 Claims, 10 Drawing Sheets

LIQUID SUPPLY MECHANISM AND IMAGE FORMING APPARATUS

CROSS-REFERENCE TO RELATED APPLICATIONS

This application is based on and claims priority under 35 USC 119 from Japanese Patent Application No. 2011-143450 filed on Jun. 28, 2011.

BACKGROUND

Technical Field

The present invention relates to a liquid supply mechanism and an image forming apparatus.

SUMMARY

According to an aspect of the invention, a liquid supply mechanism includes: a supply pathway that supplies liquid to a plurality of ejection sections each ejecting the liquid from nozzles; a branching path that is branched off from the supply pathway and through which the liquid circulates; a buffer unit that is disposed in the branching path and that lessens pressure fluctuations occurred in the liquid in the branching path; and a changing unit that changes a pathway to the buffer unit so that the changing unit shuts the pathway to the buffer unit during maintenance for discharging the liquid from the nozzles of the ejection sections. The liquid discharged during the maintenance is greater in quantity than the liquid discharged during normal operation.

BRIEF DESCRIPTION OF THE DRAWINGS

Exemplary embodiment(s) of the present invention will be described in detail based on the following figures, wherein.

DETAILED DESCRIPTION

One exemplary embodiment of the present invention is hereunder described by reference to the drawings.

In the embodiment, an inkjet recorder that records an image on a recording medium by ejecting ink droplets is now described by way of an example image forming apparatus.

The image forming apparatus is not confined to the inkjet recorder. Any image forming apparatus forming an image by means of liquid is adopted. Hence, the image forming apparatus can also be; for instance, a color filter production unit that produces a color filter by ejecting ink, or the like, over a film or glass; an apparatus that forms an EL display panel by ejecting an organic EL solution over a substrate; an apparatus that forms bumps for use in populating components by ejecting dissolved solder over a substrate; an apparatus that forms a wiring pattern by ejecting metal-containing liquid; and a variety of film formation units that form a film by ejecting liquid droplets.

(A Configuration of the Inkjet Recorder)

Figure 1:
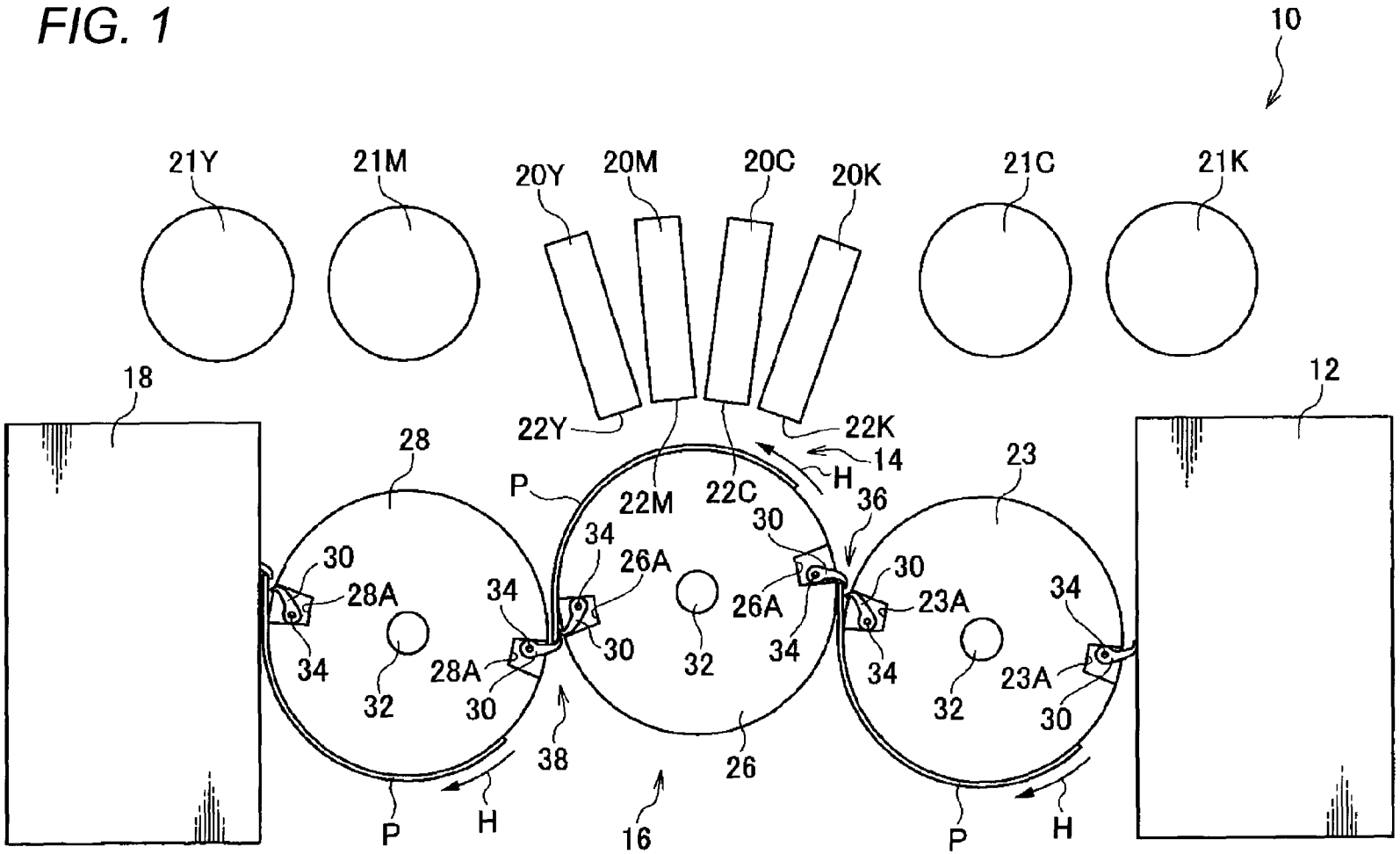
FIG. 1 is a schematic illustration showing a configuration of an inkjet recorder.

First, a configuration of the inkjet recorder is described. FIG. 1 is a schematic illustration showing a configuration of the inkjet recorder of the embodiment.

As shown in FIG. 1, an inkjet recorder 10 includes a recording medium storage section 12 that stores a recording medium P, like sheets; an image recording section (an example image formation section) 14 that records an image on the recording medium P; conveyance section 16 that conveys the recording medium P from the recording medium storage section 12 to the image recording section 14; and a recording medium discharge section 18 to which the recording medium P on which the image has been recorded by the image recording section 14 is discharged.

The image recording section 14 has, by way of example ejection sections for ejecting liquid, inkjet recording heads 20Y, 20M, 20C, and 20K (hereinafter designated by 20Y to 20K) that eject ink droplets, to thus record an image on the recording medium.

The inkjet recording heads 20Y to 20K have nozzle surfaces 22Y to 22K in which nozzles (omitted from the drawings) are fabricated, respectively. Each of the nozzle surfaces 22Y to 22K has a recordable area that is equal to or larger than the maximum width of the recording medium P on which the inkjet recorder 10 is supposed to record an image. The width of the recording medium P is equal to a length achieved in a direction orthogonal to a direction H of conveyance of the recording medium P (a depthwise direction of a paper sheet shown in FIG. 1).

Moreover, the inkjet recording heads 20Y to 20K are arranged side by side in sequence of a yellow (Y) color, a magenta (M) color, a cyan (C) color, and a black (K) color, from a downstream side with respect to a direction H of conveyance of the recording medium P. The inkjet recording heads are configured so as to eject ink droplets of corresponding colors from the plurality of nozzles by means of a piezoelectric system, thereby recording an image. In relation to a configuration for letting the inkjet recording heads 20Y to 20K eject ink droplets, another configuration that allows ejection of ink, such as a thermal ejection system, or the like, can also be adopted.

The inkjet recorder 10 is equipped with ink tanks 21Y, 21M, 21C, and 21K (hereinafter denoted by 21Y to 21K) that store ink of respective colors as a reservoir section that reserves liquid. Ink is supplied from the ink tanks 21Y to 21K to the respective inkjet recording heads 20Y to 20K. Various types of ink, such as aqueous ink, oil ink, and solvent ink, are usable as the ink supplied to the inkjet recording heads 20Y to 20K.

The conveyance section 16 has a pickup drum 23 for picking up the recording medium P in the recording medium storage section 12 one at a time; a conveyance drum 26 serving as a conveyance member that conveys the recording medium P to the inkjet recording heads 20Y to 20K of the image recording section 14 and that causes a recording surface (front surface) of the recording medium P to oppose the inkjet recording heads 20Y to 20K; and a delivery drum 28 that sends the recording medium P on which the image has been recorded to the recording medium discharge section 18. The pickup drum 23, the conveyance drum 26, and the delivery drum 28 are respectively configured in such a way that the recording medium P is held on a peripheral surface of each of the drums by electrostatic adhesion or nonelectrostatic adhesion, like suction or sticking The pickup drum 23, the conveyance drum 26, and the delivery drum 28 each have; for instance, a pair of grippers 30 that each serve as holding section for gripping a downstream end of the recording medium P in its direction of conveyance. In this case, the three drums 23, 26, and 28 are configured so as to be able to grip a maximum of two recording mediums P over the peripheral surface of each drum by means of the gripper 30. Each pair of grippers 30 is provided in two indentations 23A formed in the peripheral surface of the pickup drum 23, two indentations 26A formed in the peripheral surface of the conveyance drum 26, and two indentations 28A formed in the peripheral surface of the delivery drum 28.

Specifically, a rotating shaft 34 is supported at a predetermined position in each of the indentations 23A of the drum 23 along its rotating shaft 32, each of the indentations 26A of the drum 26 along its rotating shaft 32, and each of the indentations 28A of the drum 28 along its rotating shaft 32. The plurality of grippers 30 are secured to the rotary shaft 34 at intervals along its axial direction. Therefore, the grippers 30 rotate forwardly and backwardly along a circumferential direction of each of the drums 23, 26, and 28 as a result of the rotating shafts 34 being rotated forwardly and backwardly by unillustrated actuators, thereby gripping and releasing the downstream ends of the respective recording mediums P in the direction of conveyance.

Specifically, the grippers 30 rotate in such a way that tip ends of the respective grippers 30 slightly project out of the respective peripheral surfaces of the respective drums 23, 26, and 28, thereby transferring the recording mediums P from the respective gripper 30 of the pickup drum 23 to the gripper 30 of the conveyance drum 26 at a position of transfer 36 where the peripheral surface of the pickup drum 23 opposes the peripheral surface of the conveyance drum 26. Further, the recording medium P is transferred from the gripper 30 of the conveyance drum 26 to the gripper 30 of the delivery drum 28 at a position of transfer 38 where the peripheral surface of the conveyance drum 26 opposes the peripheral surface of the delivery drum 28.

Figure 2:
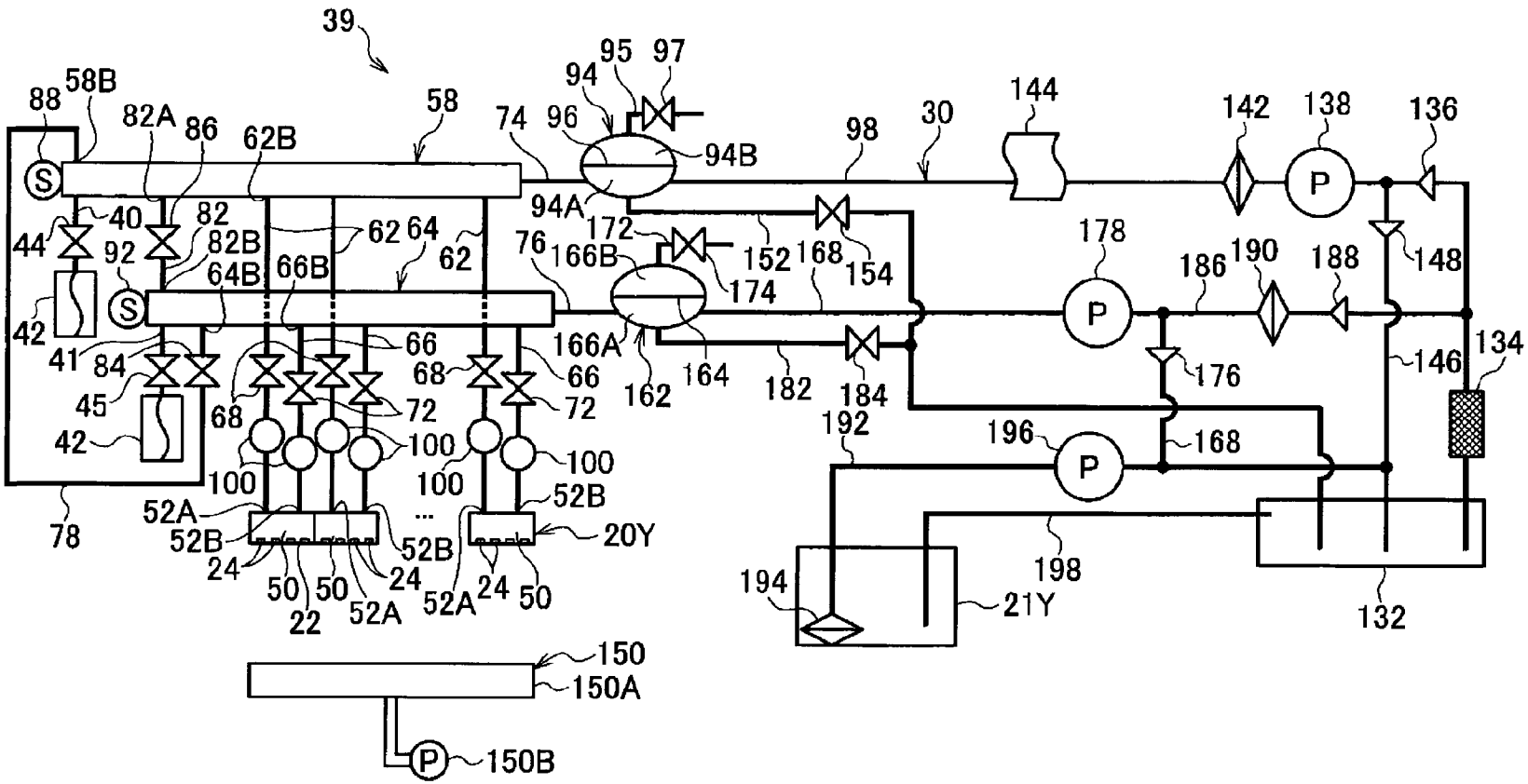
FIG. 2 is a schematic diagram showing a configuration of an ink supply mechanism.

The inkjet recorder 10 also has a maintenance unit 150 that maintains the respective inkjet recording heads 20Y to 20K (see FIG. 2). The maintenance unit 150 has a cap 150A that covers nozzle surfaces (ejection modules 50 to be described later) of the respective inkjet recording heads 20Y to 20K, a receiving member for receiving liquid droplets squired by means of preliminary ejection (blank ejection), a cleaning member that cleans the nozzle surface, a suction device 150B for sucking the ink still remaining in the nozzle, and the like. The maintenance unit 150 moves to a facing position where the maintenance unit 150 faces each of the inkjet recording heads 20Y to 20K and where tie maintenance unit 150 performs various maintenance operations.

Image recording operation (example image forming operation) of the inkjet recorder 10 is now described.

The recording medium P picked up from the recording medium storage section 12 one at a time by means of the gripper 30 of the pickup drum 23 is conveyed while being attached to the peripheral surface of the pickup drum 23 by suction. The recording medium P is transferred, at the position of transfer 36, from the gripper 30 of the pickup drum 23 to the gripper 30 of the conveyance drum 26.

The recording medium P held by the gripper 30 of the conveyance drum 26 is conveyed to image recording positions of the inkjet recording heads 20Y to 20K while adhering to the conveyance drum 26. An image is recorded on a recording surface of the recording medium P by means of ink droplets ejected from the respective inkjet recording heads 20Y to 20K.

The recording medium P on the recording surface of which the image has been recorded is transferred from the gripper 30 of the conveyance drum 26 to the gripper 30 of the delivery drum 28 at the position of transfer 38. The recording medium P held by the gripper 30 of the delivery drum 28 is conveyed while being attached by suction and then discharged to the recording medium discharge section 18. As mentioned above, a series of image recording operations is performed.

(A Configuration of an Ink Supply Mechanism)

An explanation is now given to a configuration of an ink supply mechanism serving as an example liquid supply mechanism that supplies ink to the inkjet recording heads 20Y to 20K of the image recording section 14. Since ink supply mechanisms assigned to the respective inkjet recording heads 20Y to 20K have the same configuration, an explanation is hereunder given to, as an example, the ink supply mechanism assigned to the inkjet recording head 20Y. FIG. 2 is a schematic diagram showing the ink supply mechanism 39 that supplies ink to the inkjet recording head 20Y.

As shown in FIG. 2, the inkjet recording head 20Y has a plurality of ejection modules 50 as an example ejection section that ejects ink from nozzles 24. Each of the ejection modules 50 has a supply port 52A capable of supplying ink to the inside of the ejection module 50 from the outside and a discharge port 52B capable of discharging the ink supplied by way of the supply port 52A to the outside form the inside of the ejection module 50.

One end of an ink circulable individual supply channel 62 is connected to each of the supply ports 52A of the plurality of ejection modules 50. The other ends of the respective individual supply channels 62 are connected to different positions on an ink circulable supply-side manifold 58.

One end of an ink circulable individual discharge channel 66 is connected to each of the discharge ports 52B of the plurality of ejection modules 50. The other ends of the respective individual discharge channel 66 are connected to different positions on an ink circulable discharge-side manifold 64.

Each of the individual supply channel 62 is provided with a supply-side valve 68 serving as a first open-close mechanism capable of opening and closing the corresponding individual supply channel 62. When the supply-side valves 68 are open, the individual supply channels 62 allow circulation of ink. However, when the supply-side valves 68 are switched to be closed, circulation of ink through the individual supply channels 62 is blocked.

A buffer 100 that lessens pressure fluctuations occurred in ink within each individual supply channel 62 is provided in each of the individual supply channels 62 at a position between the supply-side valve 68 and the ejection module 50.

Each of the individual discharge channels 66 is provided with a discharge-side valve 72 serving as a second open-close mechanism capable of opening and closing the corresponding individual discharge channel 66. When the discharge-side valves 72 are open, the individual discharge channels 66 allow circulation of ink. However, when the discharge-side valves 72 are switched to be closed, circulation of ink through the individual discharge channels 66 is blocked.

The buffer 100 that lessens pressure fluctuations occurred in ink within each individual discharge channel 66 is provided in each of the individual discharge channels 66 at a position between the discharge-side valve 72 and the ejection module 50.

In an ink supply mechanism 39, the ink supplied to the supply-side manifold 58 is supplied, under predetermined pressure (hereinafter referred to as "P1") and at a predetermined flow rate, to the respective ejection modules 50 from the supply-side manifold 58 by way of the individual supply channels 62. The ink supplied to the ejection modules 50 is discharged, under predetermined pressure (hereinafter referred to as "P2") and at a predetermined flow rate, to the discharge-side manifold 64 from the respective ejection modules 50 by way of the individual discharge channels 66.

In each of the ejection modules 50, differential pressure ΔP (=P1−P2) develops between the supply-side pressure P1 and the discharge-side pressure P2, thereby imparting to a nozzle surface 22 back pressure P3 that is average pressure of a total of the pressure P1 and the pressure P2. The plurality of nozzles 24 of each ejection module 50 hold ink by virtue of the back pressure P3. An energy generation element (omitted from the drawings) intended for discharging ink discharges ink according to image information.

As shown in FIG. 2, one end (a left end in FIG. 2) of a supply pipe 74 is connected to one longitudinal end (a right end in FIG. 2) of the supply-side manifold 58. In addition, one end (a left end in FIG. 2) of a discharge pipe 76 is connected to one longitudinal end (a right end in FIG. 2) of the discharge-side manifold 64.

Moreover, a supply-side pressure sensor 88 that detects pressure of ink circulating through the inside of the supply-side manifold 58 is provided on the other end (the left end shown in FIG. 2) of the supply-side manifold 58. A discharge-side pressure sensor 92 that detects pressure of the ink circulating through the inside of the discharge-side manifold 64 is provided on the other end (the left end in FIG. 2) of the discharge-side manifold 64.

The other end of the supply pipe 74 joined to the supply-side manifold 58 is joined to a supply-side sub-tank 94. The supply-side sub-tank 94 has a double chamber structure; that is, the inside of the supply-side sub-tank 94 is partitioned by means of an elastic membrane member 96 into a lower ink sub-tank 94A and an upper air chamber 94B. One end of a supply-side main pipe 98 for withdrawing ink from a buffer tank 132 joined to the ink tank 21Y is joined to the ink sub-tank 94A. The other end of the supply-side main pipe 98 is joined to the buffer tank 132. An open pipe 95 is joined to the air chamber 94B and equipped with a supply-side air valve 97.

The supply-side main pipe 98 is provided with, in sequence from the buffer tank 132 to the supply-side sub-tank 94, a deaerator module 134, a one-way valve 136, a supply-side pump 138 that pressurizes ink, a supply-side filter 142, and an ink temperature controller 144. During the course of the ink stored in the buffer tank 132 being supplied to the supply-side sub-tank 94 by means of driving force of the supply-side pump 138, air bubbles are removed from the ink, and the temperature of the ink is also managed. Aside from the supply-side main pipe 98, one end of a branching pipe 146 is joined to an input-side of the supply-side pump 138. Further, the other end of the branching pipe 146 is joined to the buffer tank 132 by way of a one-way valve 148.

One end of a drain pipe 152 is joined to the ink sub-tank 94A, and the other end of the drain pipe 152 is joined to the buffer tank 132. The drain pipe 152 is joined to a supply-side drain valve 154.

Since the supply-side sub-tank 94 is structured so as to trap air bubbles in the flow path by circulation of ink. Therefore, as a result of the supply-side drain valve 154 being opened, the air bubbles in the supply-side sub-tank 94 are sent to the buffer tank 132 by driving force of the supply-side pump 138, thereupon exiting from the buffer tank 132 opened to the air.

Next, the other end of the discharge pipe 76 joined to the discharge-side manifold 64 is joined to a discharge-side sub-tank 162. The discharge-side sub-tank 162 has a double chamber structure; that is, the discharge-side sub-tank 162 is partitioned by an elastic membrane member 164 into a lower ink sub-tank 166A and an upper air chamber 166B. One end of a discharge-side main pipe 168 for withdrawing ink into the buffer tank 132 is joined to the ink sub-tank 166A. The other end of the discharge-side main pipe 168 is joined to the buffer tank 132. An open pipe 172 is joined to the air chamber 166B, and the open pipe 172 is provided with a discharge-side air valve 174.

The discharge-side main pipe 168 is equipped with a one-way valve 176 and a discharge-side pump 178 in sequence toward the discharge-side sub-tank 162. The ink in the discharge-side sub-tank 162 is discharged to the buffer tank 132 by means of driving force of the discharge-side pump 178. Further, one end of a drain pipe 182 is joined to the ink sub-tank 166A, and the other end of the drain pipe 182 is connected to the drain pipe 152 by way of a discharge-side drain valve 184.

The discharge-side sub-tank 162 is structured so as to trap air bubbles in the flow path by circulation of ink. Hence, as a result of opening of the discharge-side drain valve 184, the air bubbles in the discharge-side sub-tank 162 are sent to the buffer tank 132 by means of driving force stemming from reverse rotation of the discharge-side pump 178, thereby exiting from the buffer tank 132 opened to the air.

In the embodiment, although a relationship of P1>P2 exists between the pressure P1 of the supply-side manifold 58 and the pressure P2 of the discharge-side manifold 64, the respective manifolds supply negative pressure. Specifically, the pressure supplied by the supply-side pump 138 is negative pressure, and the discharge pressure of the discharge-side pump 178 is much greater negative pressure. Hence, ink flows from the supply-side manifold 58 to the discharge-side manifold 64, and the back pressure P3 exerted on the nozzle 24 of each of the ejection modules 50 is maintained at negative pressure {(P1+P2)/2}. Strictly speaking, since the height of the supply-side manifold 58, the height of the discharge-side manifold 64, the quantity of ink flow, the resistance of the flow path, and the like, are involved as elements of the back pressure P3, the elements must be taken into account when the input-side pressure P1 and the output-side pressure P2 are set.

The supply-side pump 138 and the discharge-side pump 178 are built, as examples, from a tube pump [that supplies ink in a tube while an elastic tube is squeezed by means of rotational driving of a stepping motor (omitted from the drawings)]. However, the pumps are not configured particularly to the tube pump. Further, the supply-side pump 138 and the discharge-side pump 178 can be driven so as to impart positive pressure to the supply-side manifold 58 and the discharge-side manifold 64.

In the meantime, a press purge pipe 186 is interposed between an input side of the discharge-side pump 178 and an output side of the deaerator module 134 disposed in the supply-side main pipe 98. The press purge pipe 186 is equipped with, in sequence from the deaerator module 134 to the discharge-side pump 178, a one-way valve 188 and a discharge filter 190. Specifically, when air bubbles, or the like, are eliminated by pressurizing the inside of each of the ejection modules 50 and discharging the ink at one time, the discharge-side pump 178 is rotated reversely with respect to its normal direction of rotation in addition to driving of the supply-side pump 138, thereby supplying deaerated ink from the buffer tank 132 to the discharge-side manifold 64.

The buffer tank 132 allows circulation of ink with respect to the ink tank 21Y (the main tank) by means of a replenishment pipe 192 provided with a replenishment pump 196. The buffer tank 132 is configured so as to store a quantity of ink required for circulation of ink and to be replenished with ink from the ink tank 21Y according to ink consumption. A filter 194 is attached to one end of the replenishment pipe 192 (the inside of the ink tank 21Y). An overflow pipe 198 is interposed between the buffer tank 132 and the ink tank 21Y. When the buffer tank 132 is excessively replenished, the ink is returned to the ink tank 21Y.

In the ink supply mechanism 39, one end of an ink circulable first circulation path 78 is connected to a downstream side of the supply-side manifold 58 along the direction of circulation of ink when viewed from a connection section 62B of the individual supply channel 62 connected to the most downstream position (the leftmost position in FIG. 2) on the supply-side manifold 58. The other end of the first circulation path 78 is connected to an upstream side on the discharge-side manifold 64 in the direction of circulation of ink when viewed from a connection section 66B of the individual discharge channel 66 connected to the most upstream position (the leftmost position in FIG. 2) on the discharge-side manifold 64. The first circulation path 78 thereby lets ink circulate between the supply-side manifold 58 and the discharge-side manifold 64 in parallel with the respective ejection modules 50.

The first circulation path 78 is provided with a first circulation valve 84 serving as a third open-close mechanism capable of opening and closing the first circulation path 78. When the first circulation valve 84 is open, the first circulation path 78 allows circulation of ink. On the contrary, when the first circulation valve 84 is switched to be closed, circulation of ink through the first circulation path 78; that is, circulation of ink between the supply-side manifold 58 and the discharge-side manifold 64, is blocked.

One end of an ink circulable second circulation path 82 is connected to the supply-side manifold 58 at a position that is on the downstream side (the left side in FIG. 2) in the direction of circulation of ink with respect to the connection section 62B of the individual supply channel 62 and on the upstream side (the right side in FIG. 2) in the direction of circulation of ink with respect to a connection section 58B of the first circulation path 78 on the supply-side manifold 58. The other end of the second circulation path 82 is connected to the discharge-side manifold 64 at an upstream side in the direction of circulation of ink with respect to the connection section 64B of the first circulation path 78 on the discharge-side manifold 64. The second circulation path 82 thereby lets ink circulate between the supply-side manifold 58 and the discharge-side manifold 64 in parallel with the respective ejection modules 50 and the first circulation path 78.

An upstream end of the second circulation path 82 can also be connected to a further downstream side (a further left side in FIG. 2) with respect to the connection section 58B of the first flow path 78 in the direction of circulation of ink. Alternatively, the upper end of the second circulation path 82 can also be connected to a further upstream side (a further right side in FIG. 2) with respect to the connection section 62B of the individual supply channel 62 in the direction of circulation of ink or connected to any location on the supply-side manifold 58. Moreover, the downstream end of the second circulation path 82 can also be connected to a further downstream side (a further right side in FIG. 2) in the direction of circulation of ink with respect to the connection section 64B of the first circulation path 78.

The second circulation path 82 is provided with a second circulation valve 86 serving as a fourth open-close mechanism capable of opening and closing the second circulation path 82. When the second circulation valve 86 is open, the second circulation path 82 allows circulation of ink. On the contrary, when the second circulation valve 86 is switched to be closed, circulation of ink through the second circulation path 82; that is, circulation of ink between the supply-side manifold 58 and the discharge-side manifold 64, is blocked.

A solenoid valve (an electromagnetic valve) that opens and closes a valve by means of force generated by; for instance, a solenoid, is preferable as a second circulation valve 86. However, the second circulation valve may also be configured in another way; for instance, it is configured so as to open and close the valve by means of driving force of a motor. The same also applies to the foregoing supply-side valve 68, the discharge-side valve 72, and the first circulation valve 84.

In the present embodiment, the ink supply mechanism 39 has a supply-side branching path 40 branched off from the supply-side manifold 58 and a discharge-side branching path 41 branched off from the discharge-side manifold 64. The supply-side branching path 40 is branched off from the supply-side manifold 58 at a further downstream side (a further left side in FIG. 2) in the direction of circulation of ink with respect to the connection section 62B of the individual supply channel 62. The discharge-side branching path 41 is branched off from the discharge-side manifold 64 at a further upstream side (a further left side in FIG. 2) in the direction of circulation of ink with respect to the connection section 66B of the individual discharge channel 66.

The supply-side branching path 40 can also be branched off from a further upstream side (a further right side in FIG. 2) in the direction of circulation of ink with respect to the connection section 62B of the individual supply channel 62. Moreover, the supply-side branching path 40 can also be branched toward either the upstream side or the downstream side in the direction of circulation of ink with respect to the connection section 58B of the first circulation path 78 and a connection section 82A of the second circulation path 82 to the supply-side manifold 58. Further, the supply-side branching path 40 can also be branched at any position on the supply-side manifold 58. Moreover, the discharge-side branching path 41 can also be branched off from a further downstream side (a further right side in FIG. 2) in the direction of circulation of ink with respect to the connection section 66B of the individual discharge channel 66. Moreover, the discharge-side branching path 41 can also be branched toward either the upstream side or the downstream side in the direction of circulation of ink with respect to the connection section 64B of the first circulation path 78 and a connection section 82B of the second circulation path 82 to the discharge-side manifold 64. Further, the discharge-side branching path 41 can also be branched off at any location on the discharge-side manifold 64.

The supply-side branching path 40 is equipped with a buffer unit 42 that lessens pressure fluctuations developed in ink within the supply-side branching path 40. A supply-side branching path valve 44 serving as a cutoff section capable of cutting off the pressure of the buffer unit 42 from the pressure of the supply-side manifold 58 (a supply pathway, in particular, which will be described later) is provided in the supply-side branching path 40 at a position closer to the supply-side manifold 58 (to the ejection modules 50) than to the buffer unit 42. When the supply-side branching path valve 44 is open, the supply-side branching path 40 allows circulation of ink (can propagate pressure). On the other hand, when the supply-side branching path valve 44 is switched to be closed, circulation of ink of the supply-side branching path 40 is blocked, whereby the pressure of the buffer unit 42 is cut off from the pressure of the supply-side manifold 58 (a supply pathway, in particular, which will be described later).

The discharge-side branching path 41 is equipped with the buffer unit 42 that lessens pressure fluctuations developed in ink within the discharge-side branching path 41. A discharge-side branching path valve 45 serving as a cutoff section capable of cutting off the pressure of the buffer unit 42 from the pressure of the discharge-side manifold 64 (a discharge pathway, in particular, which will be described later) is provided in the discharge-side branching path 41 at a position closer to the discharge-side manifold 64 (to the ejection modules 50) than to the buffer unit 42. When the discharge-side branching path valve 45 is open, the discharge-side branching path 41 allows circulation of ink (can propagate pressure). On the other hand, when the discharge-side branching path valve 45 is switched to be closed, circulation of ink of the discharge-side branching path 41 is blocked, whereby the pressure of the buffer unit 42 is cut off from the pressure of the discharge-side manifold 64 (a discharge pathway, in particular, which will be described later).

As a result of pressure being cut off in the manner as mentioned above, the buffers 42 come into an inoperative state in which lessening action for lessening pressure fluctuations is not yielded. Specifically, the discharge-side branching path valve 45 and the supply-side branching path valve 44 each acting as an inoperative unit that brings the corresponding buffer unit 42 into inoperative state where lessening action for lessening pressure fluctuations is not yielded. Also, the discharge-side branching path valve 45 and the supply-side branching path valve 44 each acting as a changing unit that changes a pathway to the corresponding buffer unit 42 so that the changing unit shuts the pathway to the corresponding buffer unit 42 during maintenance for discharging the liquid from the nozzles of the ejection sections.

Figure 4B:
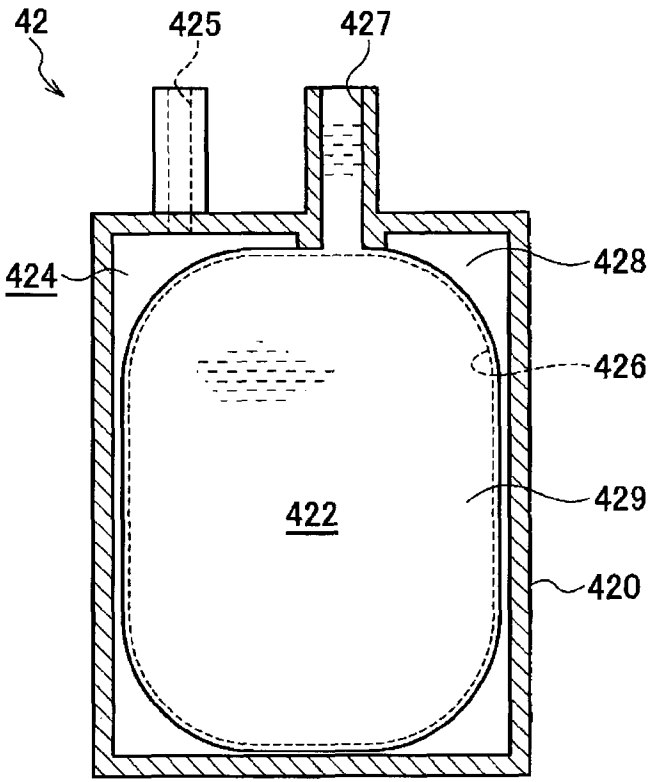
FIGS. 4A and 4B are schematic illustrations showing a configuration of a buffer.
Figure 4A:
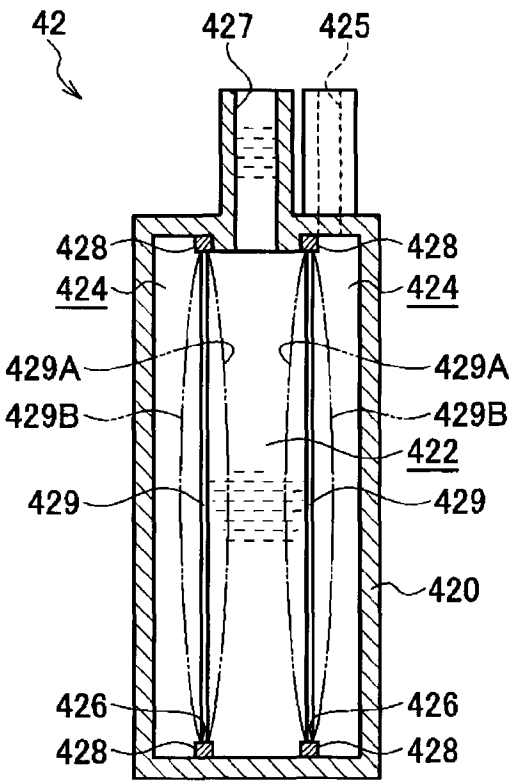

As shown in FIGS. 4A and 4B, each of the buffers 42 has a box-shaped housing 420 in which air chambers 424 and an ink chamber 422 are formed in such a way that the ink chamber 422 is sandwiched between the air chambers 424. Further, a pair of partition plates 428 for partitioning the ink chamber 422 from the air chambers 424 are provided in the housing 420. An opening 426 is formed in each of the partition plates 428. Each of the partition plates 428 is provided with an elastic membrane 429 so as to close the opening 426. The housing 420 has an ink inlet port 427 for letting ink in the ink chamber 422 and an air inlet port 425 for letting air in the air chambers 424. The air chambers 424 can also be configured so as to be open to the air by way of the air inlet port 425 or sealed. Alternatively, a pump may also be connected to the air inlet port 425, and air is let in or out of the air chambers 424 by way of the air inlet port 425, thereby pressurizing or depressurizing the air chambers 424 to thus vary a buffer level. Incidentally, the buffer unit 42 is not limited to that shown in FIGS. 4A and 4B and may also employ another configuration, so long as the configuration allows lessening of pressure fluctuations.

The volume of ink in each of the buffers 42 is made larger than at least the volume of each of the buffers 100 provided in the individual supply channels 62 and the individual discharge channels 66. Specifically, the volume of each of the buffers 42 is made larger than a total volume of all of the buffers 100 provided in; for instance, the individual supply channels 62 (or the individual discharge channels 66). Thus, the buffer unit 42 is set so as to become higher than the buffers 100 in terms of lessening capability of lessening pressure fluctuations. Lessening capability of the buffers 100 is set to a level at which the buffers 100 can lessen pressure fluctuations due to a change in the quantity of ink ejected by a single ejection module 50 and a level at which the lessening capability does not affect maintenance operation to be described later. Specifically, during maintenance operation, pressure that surpasses the upper limit of the lessening capability of the buffers 100 acts on the ejection module 50. On the contrary, lessening capability of each of the buffers 42 is at a level at which there can be lessened pressure fluctuations developing in the supply-side manifold 58 (or the discharge-side manifold 64) as a result of the plurality of ejection modules 50 simultaneously ejecting ink during recording of an image. As a consequence, the lessening capability of the buffer unit 42 is set to a level at which the buffer unit 42 affects maintenance operation performed in a pressure process to be described later. The level at which the buffer unit 42 affects the maintenance operation herein refers to one at which pressure drops during pressure rising in maintenance operation effected in the pressure process to be described later, whereby a time that elapses before pressure rises to a desired level becomes longer or supplying required pressure becomes impossible.

For instance, a solenoid valve (an electromagnetic valve) that opens and closes a valve by means of force developed in a solenoid is preferable for the supply-side branching path valve 44 and the discharge-side branching path valve 45. However, the valves are not limited to the solenoid valve. For instance, there may also be employed a mechanism that turns a cam to squeeze a tube making up the supply-side branching path 40 (or the discharge-side branching path 41), thereby cutting off pressure.

An open-close valve that opens and closes the ink inlet port 427 of each of the buffers 42 rather than opening and closing the supply-side branching path 40 and the discharge-side branching path 41 can also be employed as the supply-side branching path valve 44 and the discharge-side branching path valve 45.

Further, a configuration that stops the buffers 42 and lessening actions of the buffers 42 for lessening pressure fluctuations can also be employed as the inoperative unit that brings the buffers into an inoperative state in which lessening action for lessening pressure fluctuations is not yielded. Specifically, an example configuration is to pressurize or depressurize each of the buffers 42 by way of its air inlet port 425, thereby making stationary the elastic membranes 429 against pressure fluctuations in ink, or to add movable wall surfaces for making the elastic membranes 429 stationary.

In the ink supply mechanism 39, the common supply pathway along which ink of the supply-side sub-tank 94 (an example reservoir) is supplied to the respective individual supply channels 62 is built from the supply-side manifold 58 and the supply pipe 74. The supply path along which the ink of the supply-side sub-tank 94 is supplied to the respective ejection modules 50 is made up of the common supply pathway and the individual supply channels 62.

A common supply pathway along which ink of the supply-side sub-tank 94 is supplied to the individual supply channels 62 corresponds to an upstream part (on the right side in FIG. 2) in the direction of circulation of ink when viewed from the supply pipe 74 and the connection section 62B of the individual supply channel 62 connected to the supply-side manifold 58 at the most downstream position (the most left point in FIG. 2) in the direction of circulation of ink. Individual supply pathways along which the ink is supplied from the common supply pathway to the respective ejection modules 50 are made up of the individual supply channels 62. A supply pathway along which the ink of the supply-side sub-tank 94 is supplied to the respective ejection modules 50 is built from the individual supply pathways and the common supply pathway.

A branching pathway branched off from the common supply pathway corresponds to a downstream part (on the left side in FIG. 2) in the direction of circulation of ink when viewed from the supply-side branching path 40 and the connection sections 62B of the individual supply channels 62. Specifically, the branching pathway is branched off from the common supply pathway at a downstream position in the direction of circulation of ink with respect to the connection sections 62B of the individual supply channels 62. Moreover, the buffer unit 42 can be to be placed in the branching pathway. Hence, the buffer unit 42 can also be disposed on a downstream side (the left side in FIG. 2) in the direction of circulation of ink when viewed from the connection sections 62B of the individual supply channels 62 on the supply-side manifold 58.

When viewed from the buffer tank 132 (an example reservoir) that is taken as a starting point, the common supply pathway is built from the supply-side manifold 58, the supply pipe 74, the supply-side sub-tank 94, and the supply-side main pipe 98. When viewed from the ink tank 21Y (an example reservoir) that is taken as a starting point, the common supply pathway is built from the supply-side manifold 58, the supply pipe 74, the supply-side sub-tank 94, the supply-side main pipe 98, the buffer tank 132, and the replenishment pipe 192.

In the ink supply mechanism 39, a common discharge pathway along which ink is discharged from the respective individual discharge channels 66 to the discharge-side sub-tank 162 (an example reservoir) is built from the discharge-side manifold 64 and the discharge pipe 76. A discharge channel along which ink is discharged from the ejection modules 50 to the discharge-side sub-tank 162 is built from the common discharge pathway and the individual discharge channels 66.

The common discharge pathway along which ink is discharged from the respective individual discharge channels 66 to the discharge-side sub-tank 162 corresponds to a downstream part (on the right side in FIG. 2) in the direction of circulation of ink when viewed from the discharge pipe 76 and the connection section 66B of the individual discharge channel 66 connected to the discharge-side manifold 64 at the most upstream position (the most left position in FIG. 2) in the direction of circulation of ink. Individual discharge pathways along which the ink is discharged from the respective ejection modules 50 to the common discharge pathway are made up of the individual discharge channels 66. A discharge pathway along which ink is discharged from the respective ejection modules 50 to the discharge-side sub-tank 162 is built from the individual discharge pathways and the common discharge pathway.

A branching pathway branched off from the common discharge pathway corresponds to an upstream part (on the left side in FIG. 2) in the direction of circulation of ink when viewed from the discharge-side branching path 41 and the connection sections 66B of the individual discharge channels 66. Specifically, the branching pathway is branched off from the common discharge pathway at an upstream position in the direction of circulation of ink with respect to the connection sections 66B of the individual discharge channels 66. Moreover, the buffer unit 42 can be to be placed in the branching pathway. Hence, the buffer unit 42 can also be disposed on an upstream side (the left side in FIG. 2) in the direction of circulation of ink when viewed from the connection sections 66B of the individual discharge channels 66 on the discharge-side manifold 64.

When viewed from the buffer tank 132 (an example reservoir) that is taken as an end point, the common discharge pathway is built from the discharge-side manifold 64, the discharge pipe 76, the discharge-side sub-tank 162, and the discharge-side main pipe 168. When viewed from the ink tank 21Y (an example reservoir) that is taken as an end point, the common discharge pathway is built from the discharge-side manifold 64, the discharge pipe 76, the discharge-side sub-tank 162, the discharge-side main pipe 168, the buffer tank 132, and the overflow pipe 198.

In the ink supply mechanism 39, the buffer tank 132, the supply-side main pipe 98, the supply-side sub-tank 94, the supply pipe 74, the supply-side manifold 58, the individual supply channels 62, the ejection modules 50, the individual discharge channels 66, the discharge-side manifold 64, the discharge pipe 76, the discharge-side sub-tank 162, and the discharge-side main pipe 168 make up a circulation pathway for circulating ink in this sequence.

A portion of ink does not pass through the individual supply channels 62, the ejection modules 50, and the individual discharge channels 66 and circulates from the supply-side manifold 58 to the discharge-side manifold 64 by way of the second circulation path 82.

A control section 200 of the inkjet recorder 10 is now described.

Figure 3:
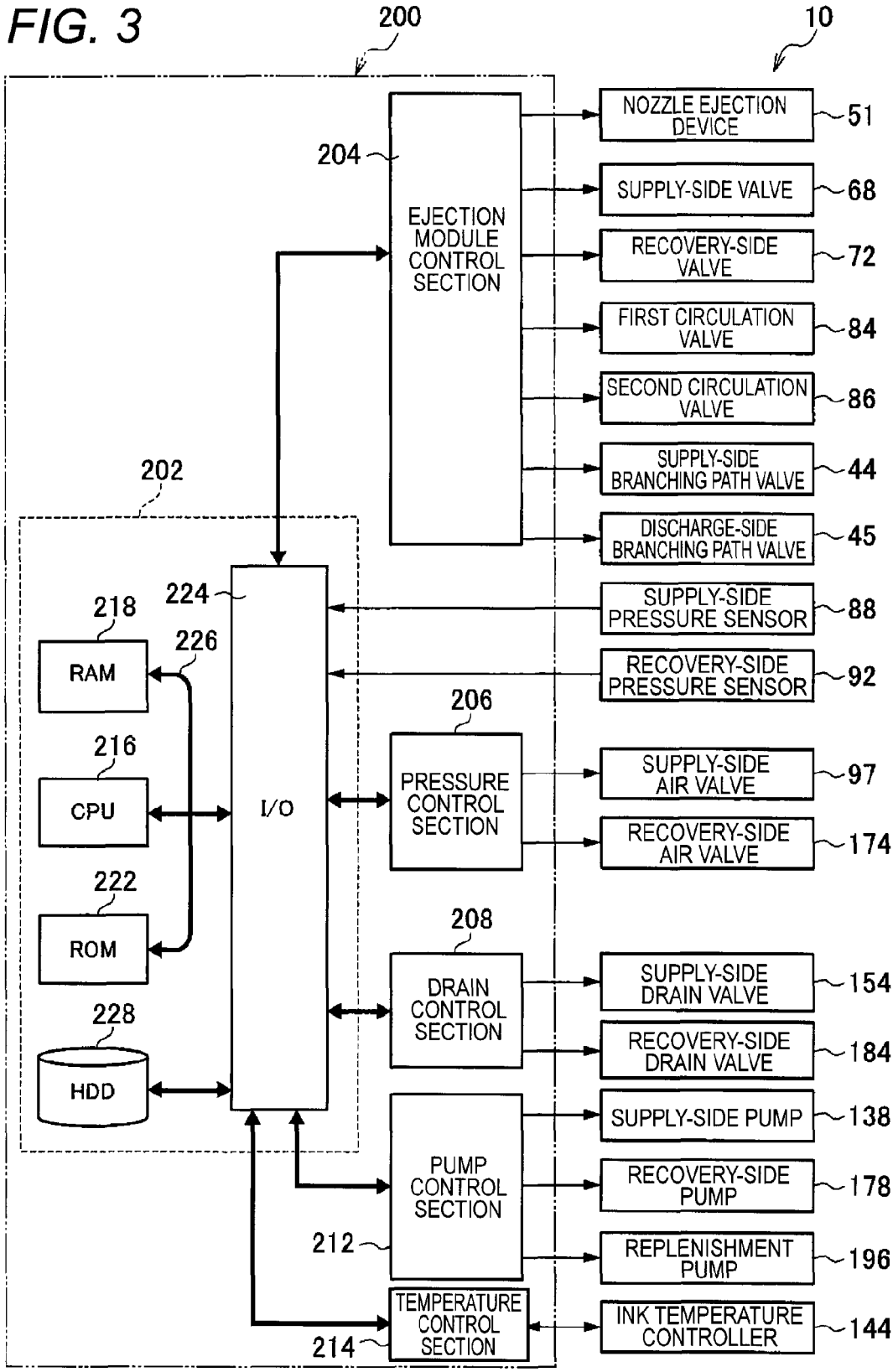
FIG. 3 is a block diagram of a control section that controls operation of an inkjet head.

As shown in FIG. 3, the inkjet recorder 10 has the control section 200 that performs, according to an input signal, control operation for switching between ejecting operation for letting the ejection modules 50 eject ink and recovery operation for letting the ejection modules 50 eject ink at pressure which is higher than that used for ejection operation.

The control section 200 includes a microcomputer 202, an ejection module control section 204 connected to the microcomputer 202, a pressure control section 206, a drain control section 208, a pump control section 212, and a temperature control section 214. The microcomputer 202 has a CPU 216, RAM 218, ROM 222, an I/O section 224, and a bus 226 like a data bus or a control bus interconnecting them.

A hard disk drive (HDD) 228 is connected to the I/O section 224. Further, the I/O section 224 is connected to the supply-side pressure sensor 88 and the discharge-side pressure sensor 92. Image data used when an image is formed by ejecting ink from the nozzles 24 (see FIG. 2) of the ejection modules 50 are input to the I/O section 224 from the outside. The image data may also be data including a predetermined position for ink ejection or a predetermined quantity of ejection or compressed data like JPEG data. The CPU 216 is configured so as to read an ink circulation system program stored in the ROM 222 and execute the program.

Example ink circulation system programs include a circulation control program for circulating ink in the buffer tank 132 from the supply-side manifold 58 to the discharge-side manifold 64, a control program for discharging ink droplets from the nozzles 24 according to image data, and a purge control program for discharging (purging) air bubbles developed in the respective ejection modules 50. The ink circulation system program is not limited to the ROM 222 but can also be stored in the HDD 228 or an external storage medium (omitted from the illustration) and acquired from a reader that reads information when the external storage medium is loaded into the reader or from a network (omitted from the illustration) like a LAN.

According to the thus-read ink circulation control program, the CPU 216 controls operation of the ejection module control section 204, the pressure control section 206, the drain control section 208, the pump control section 212, and the temperature control section 214 which all are connected to the I/O section 224. The ejection module control section 204 is connected to nozzle ejection devices 51 (e.g., devices that perform operation for ejecting ink droplets from nozzles by means of vibration in pressure chambers occurred as a result of controlled energization of piezoelectric elements) built in the respective ejection modules 50, the supply-side valves 68, the discharge-side valves 72, the first circulation valve 84, the second circulation valve 86, the supply-side branching path valve 44, and the discharge-side branching path valve 45. The ejection module control section 204 controls opening and closing of these valves.

The pressure control section 206 is connected to the supply-side air valve 97 and the discharge-side air valve 174. The pressure control section 206 controls opening and closing of these valves. The supply-side drain valve 154 and the discharge-side drain valve 184 are connected to the drain control section 208. The drain control section 208 controls opening and closing of these valves. The pump control section 212 is connected to the supply-side pump 138, the discharge-side pump 178, and the replenishment pump 196. The pump control section 212 controls driving operations of these pumps. Further, the temperature control section 214 is connected to the ink temperature controller 144. The temperature control section 214 controls driving operation of the ink temperature controller 144.

(Operation of the Ink Supply Mechanism 39 of the Present Embodiment)

Operation of the ink supply mechanism 39 of the present embodiment is now described.

(Image Recording Operation)

First, an explanation is given to operation of the ink supply mechanism 39 performed during image recording operation for recording an image on the recording medium P.

During image recording operation for recording an image on the recording medium P, the pump control section 212 activates the supply-side pump 138 and the discharge-side pump 178, thereby generating pressure used for circulating ink. At this time, the ejection module control section 204 opens all of the supply-side valves 68 and the discharge-side valves 72; opens the second circulation valve 86, the supply-side branching path valve 44, and the discharge-side branching path valve 45; and closes the first circulation valve 84.

The ink of the buffer tank 132 is supplied to the respective ejection modules 50 through the supply-side main pipe 98, the supply-side sub-tank 94, the supply pipe 74, the supply-side manifold 58, and the individual supply channels 62. When the ink supplied to the respective ejection modules 50 circulates through the supply-side main pipe 98, the temperature controller 144 controls the temperature of the ink.

The ink supplied to the respective ejection modules 50 returns to the buffer tank 132 via the individual discharge channels 66, the discharge-side manifold 64, the discharge pipe 76, the discharge-side sub-tank 162, and the discharge-side main pipe 168. A portion of the ink circulating through the supply-side manifold 58 flows to the discharge-side manifold 64 through the second circulation path 82 and returns to the buffer tank 132 via the discharge pipe 76, the discharge-side sub-tank 162, and the discharge-side main pipe 168.

The ink circulates in the manner as mentioned above. Incidentally, ink is circulated while the pump control section 212 controls the supply-side pump 138 and the discharge-side pump 178 in such a way that pressure values detected by the supply-side pressure sensor 88 and the discharge-side pressure sensor 92 come to specified values.

In the present embodiment, a portion of the ink circulating through the supply-side manifold 58 flows to the discharge-side manifold 64 via the second circulation path 82. Hence, when compared with a case where the ink does not circulate through the second circulation path 82, the quantity of ink flow achieved at a downstream position with respect to the supply-side manifold 58 increases. Thereby, when compared with a case where the ink does not circulate through the second circulation path 82, variations in ink temperature achieved in the supply-side manifold 58 are suppressed, whereby variations in ink temperature among the ejection modules 50 are suppressed.

In the present embodiment, for instance, even when pressure fluctuations have occurred in ink within the supply-side manifold 58 and the discharge-side manifold 64 as a result of ink being abruptly consumed by the plurality of ejection modules 50 for ejection, the pair of elastic membranes 429 become deformed so as to become convex toward the ink chamber 422 (see a two-dot chain line 429A in FIG. 4A), to thus make the volume of the ink chamber 422 smaller and let the ink flow from the ink chamber 422 to the supply-side manifold 58 and the discharge-side manifold 64, in each of the buffer unit 42 disposed in the supply-side branching path 40 branched off from the supply-side manifold 58 and the buffer unit 42 disposed in the discharge-side branching path 41 branched off from the discharge-side manifold 64. Hence, the pressure fluctuations in the ink in the supply-side manifold 58 and the discharge-side manifold 64 are reduced.

Moreover, for instance, even when pressure fluctuations have occurred in ink within the supply-side manifold 58 and the discharge-side manifold 64 as a result of occurrence of an abrupt decrease in the quantity of ink consumed by the plurality of ejection modules 50, the pair of elastic membranes 429 become deformed so as to become convex toward the air chamber 424 (see a two-dot chain line 429B in FIG. 4A), to thus make the volume of the ink chamber 422 larger and let the ink flow to the ink chamber 422 from the supply-side manifold 58 and the discharge-side manifold 64, in each of the buffer unit 42 disposed in the supply-side branching path 40 branched off from the supply-side manifold 58 and the buffer unit 42 disposed in the discharge-side branching path 41 branched off from the discharge-side manifold 64. Hence, the pressure fluctuations in the ink in the supply-side manifold 58 and the discharge-side manifold 64 are reduced.

In particular, when switching takes place between the state of consumption of ink and a state of nonconsumption of ink; that is, when image recording starts (when ejection starts) and when image recording ends (when ejection ends), pressure fluctuations are likely to occur in ink. Lessing action of the buffers 42 for lessening pressure fluctuations is performed at this time.

Further, in the present embodiment, the supply-side branching path 40 is branched at a downstream position (on the left side in FIG. 2) in the direction of circulation of ink when viewed from the connection sections 62B of the individual supply channels 62 of the supply-side manifold 58. Hence, pressure fluctuations in ink are thereby lessened in the downstream area of the supply-side manifold 58 where influence of the pressure fluctuations tends to become greater in the direction of circulation of ink.

Further, in the present embodiment, the discharge-side branching path 41 is branched at an upstream side (on the left side in FIG. 2) in the direction of circulation of ink when viewed from the connection sections 66B of the individual discharge channels 66 of the discharge-side manifold 64.

Hence, pressure fluctuations in ink are thereby lessened in the upstream area of the discharge-side manifold 64 in the direction of circulation of ink where influence of the pressure fluctuations tends to become greater.

In the present embodiment, since the buffer unit 42 is disposed in the supply-side branching path 40 branched off from the supply-side manifold 58, pressure fluctuations occurred in the plurality of individual supply channels 62 are collectively lessened. Further, since the buffer unit 42 is disposed in the discharge-side branching path 41 branched off from the discharge-side manifold 64, pressure fluctuations occurred in the plurality of individual discharge channels 66 are collectively lessened.

Even after the pressure fluctuations have been lessened, the pump control section 212 controls, in a follow-up manner, driving operations of the supply-side pump 138 and the discharge-side pump 178. Hence, the volume of the ink chamber 422 of the buffer unit 42 is recovered to its steady state.

(Maintenance Operation)

An explanation is now given to operation of the ink supply mechanism 39 performed during maintenance operation for discharging ink from the ejection modules 50.

Maintenance operation includes pressure process maintenance operation during which the supply-side manifold 58 is pressurized, to thus eject ink from the respective ejection modules 50 and suction process maintenance operation (a depressurization process) during which ink is sucked from the nozzles of the respective ejection modules 50, thereby ejecting ink from the ejection modules 50. By means of the maintenance operation, ink containing air bubbles and viscosity-enhanced ink are ejected from the ejection modules 50.

First, the pressure process maintenance operation is described.

During the pressure process maintenance operation, the ejection module control section 204 first closes all of the supply-side valves 68 and the discharge-side valves 72, as well as closing the supply-side branching path valve 44 and the discharge-side branching path valve 45.

Next, the ejection module control section 204 opens the first circulation valve 84 and the second circulation valve 86, as well as opening the supply-side valves 68 and the discharge-side valves 72 of the ejection modules 50 that are objects of maintenance.

The pump control section 212 then activates the supply-side pump 138 and the discharge-side pump 178, thereby pressurizing the supply-side manifold 58 and the discharge-side manifold 64 to a predetermined pressure level. The predetermined pressure level is one whose absolute value is higher than the pressure acting on the supply-side manifold 58 and the discharge-side manifold 64 at least during image recoding operation (during normal operation). The predetermined pressure level is set to; for instance, 30 to 50 kPa, with respect to the atmospheric pressure. The ink is thereby discharged along with air bubbles (or the viscosity-enhanced ink) from the ejection modules 50 through the supply-side manifold 58 and the individual supply channels 62. At this time, ink is discharged in the form of a liquid column and in quantity greater than is discharged during image recording operation.

After the supply-side manifold 58 and the discharge-side manifold 64 have been pressurized to the predetermined pressure level, the pressuring force originating from the supply-side pump 138 and the discharge-side pump 178 is reduced, and there is maintained a state in which the internal pressure of the supply-side manifold 58 and the internal pressure of the discharge-side manifold 64 gradually decrease.

When discharge of the air bubbles (the viscosity-enhanced ink) from the ejection modules 50 completes, the pump control section 212 stops the supply-side pump 138 and the discharge-side pump 178 and closes the first circulation valve 84 and the second circulation valve 86. Residual pressure in the supply-side manifold 58 is released through the supply-side sub-tank 94 and the drain pipe 152.

In the present embodiment, the supply-side branching path valve 44 and the discharge-side branching path valve 45 are closed, and hence the buffers 42 do not operate. Therefore, the pressure generated by the supply-side pump 138 and the discharge-side pump 178 is imparted to the ink without being attenuated.

An explanation is now given to the suction process (depressurization process) maintenance operation.

During the suction process maintenance operation, the ejection module control section 204 first closes all of the supply-side valves 68 and the discharge-side valves 72, as well as closing the supply-side branching path valve 44 and the discharge-side branching path valve 45.

Next, the ejection module control section 204 opens the first circulation valve 84 and the second circulation valve 86, as well as opening the supply-side valves 68 and the discharge-side valves 72 of the ejection modules 50 that are objects of maintenance.

The nozzles 24 (nozzle surfaces) of the respective ejection modules 50 are now covered with the cap 150A, and the inside of the cap 150A is depressurized for a predetermined period of time by means of the suction device 150B. Air bubbles (viscosity-enhanced ink) are thereby discharged along with ink from the respective ejection modules 50 through the supply-side manifold 58 and the individual supply channels 62. At this time, ink is discharged in the form of a liquid column and in quantity greater than is discharged during image recording operation. The pressure employed at this time ranges from −40 kPa to −60 kPa with respect to the atmospheric pressure and induces ink flow velocity sufficient for discharging the air bubbles of the ejection modules 50 that are objects of maintenance to the inside of the nozzles 24. Further, the cap 150A can individually cover each of the ejection modules 50 or collectively cover the plurality of ejection modules 50.

In the present embodiment, the supply-side branching path valve 44 and the discharge-side branching path valve 45 are closed, and the buffers 42 do not operate. Accordingly, the pressure (negative pressure) generated by the suction device 150B is imparted to the ink without being attenuated. Further, when the buffers 42 operate, air bubbles of ink become easily discharged from a portion of the supply-side manifold 58 and a portion of the discharge-side manifold 64 where the buffers 42 are provided (the left side in FIG. 2), whilst air bubbles of ink become less easily discharged from the other side of the supply-side manifold 58 and the other side of the discharge-side manifold 64 (i.e., the right side in FIG. 2). However, in the present embodiment, such a situation does not arise, because the buffers 42 do not operate.

As mentioned above, in the present embodiment, on the occasion of image recording operation, the pressure fluctuations in the ink of the supply-side manifold 58 and the ink of the discharge-side manifold 64 are lessened. However, during maintenance operation, required pressure is imparted to ink without being attenuated.

(Air Bubble Recovery Operation)

In a case where the inkjet recorder 10 remains stationary for a long period of time, or the like, air bubble recovery operation is performed. During air bubble recovery operation, the ejection module control section 204 opens the first circulation valve 84 and closes all of the other valves (the supply-side valves 68, the discharge-side valves 72, the second circulation valve 86, the supply-side branching path valve 44, and the discharge-side branching path valve 45).

The pump control section 212 activates the supply-side pump 138 and the discharge-side pump 178, thereby generating pressure used for circulating ink. The ink is at this time circulated at flow velocity that is faster than that employed during image recording operation, thereby recovering air bubbles in the buffer tank 132. The air bubbles recovered by the buffer tank 132 are released to the air.

During air bubble recovery operation, the supply-side branching path valve 44 and the discharge-side branching path valve 45 remain closed, and the buffers 42 do not operate. Accordingly, the pressure generated by the supply-side pump 138 and the discharge-side pump 178 is imparted to the ink without being attenuated.

First Example Modification

An ink supply mechanism 391 of the first example modification is now described. An explanation is herein given to a difference between the ink supply mechanism 391 and the previously-described ink supply mechanism 39.

Figure 5:
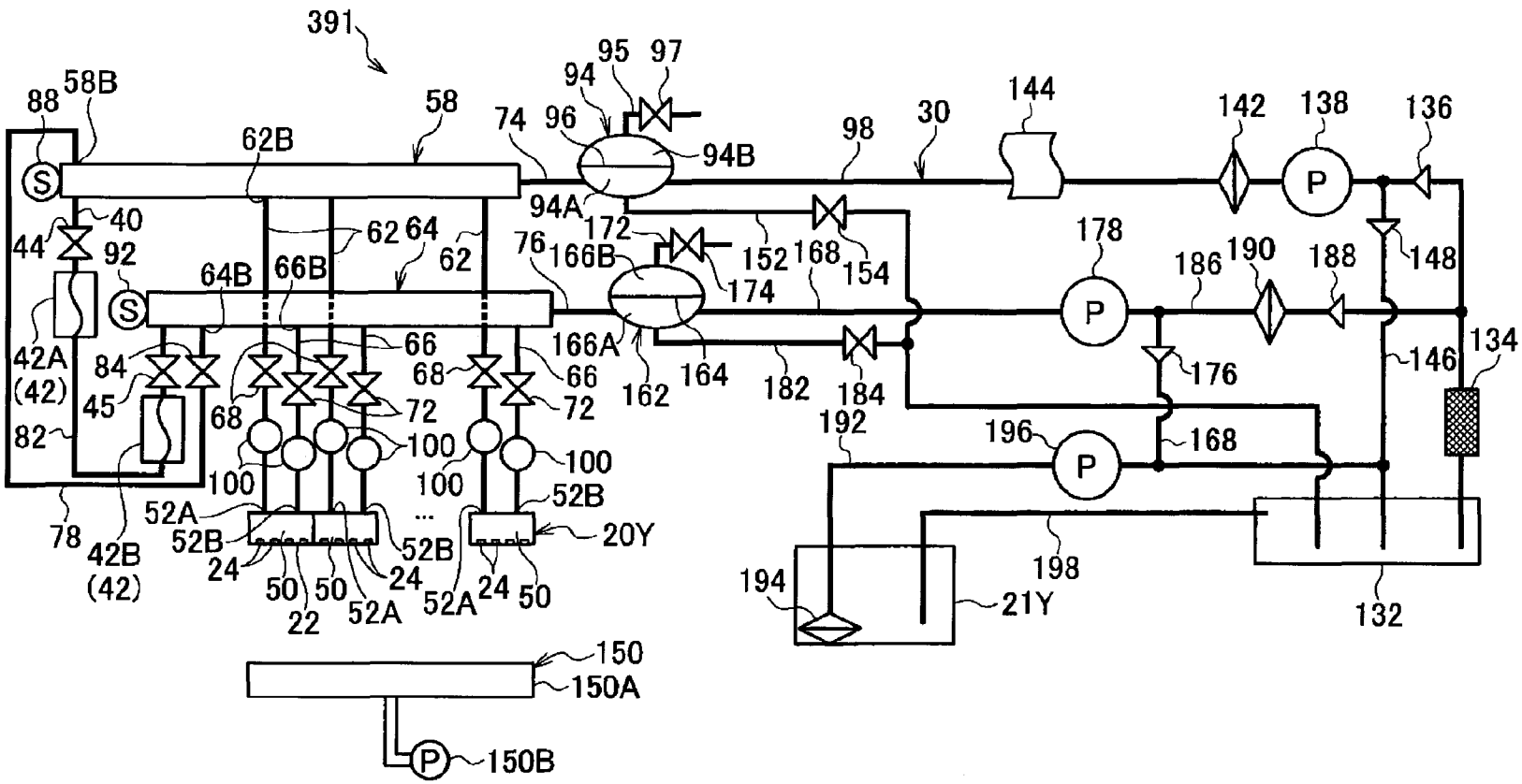
FIG. 5 is a schematic diagram showing a configuration of an ink supply mechanism of a first example modification.

As shown in FIG. 5, in the ink supply mechanism 391, the second circulation path 82 is provided with two buffers 42 when compared with the second circulation path 82 of the ink supply mechanism 39. Of the two buffers 42, one buffer unit 42A is disposed in a portion of the second circulation path 82 facing to the supply-side manifold 58, whilst a remaining buffer unit 42B is disposed in a portion of the second circulation path 82 facing to the discharge-side manifold 64.

Specifically, the second circulation path 82 acts as the supply-side branching path 40 and the discharge-side branching path 41 of the ink supply mechanism 39. The buffer unit 42A acts as the buffer unit 42 disposed in the supply-side branching path 40, and the buffer unit 42B acts as the buffer unit 42 disposed in the discharge-side branching path 41. The configuration of each of the buffers 42 disposed in the ink supply mechanism 391 is now described.

The supply-side branching path valve 44 employed in the ink supply mechanism 39 is disposed in a portion of the second circulation path 82 facing to the supply-side manifold 58 (i.e., the ejection modules 50) than to the buffer unit 42. The discharge-side branching path valve 45 employed in the ink supply mechanism 39 is disposed in a portion of the second circulation path 82 closer to the discharge-side manifold 64 (the ejection modules 50) than is the buffer unit 42.

When compared with the ink supply mechanism 39, the ink supply mechanism 391 has neither the supply-side branching path 40 nor the discharge-side branching path 41 and also has valves that become fewer in number by one.

In the ink supply mechanism 391, during the image recording operation for recording an image on the recording medium P, the pump control section 212 activates the supply-side pump 138 and the discharge-side pump 178, thereby generating pressure used for circulating ink. The ejection module control section 204 at this time opens all of the supply-side valves 68 and the discharge-side valves 72; opens the supply-side branching path valve 44 and the discharge-side branching path valve 45; and closes the first circulation valve 84.

In the pressure process maintenance operation and the suction process maintenance operation, the ejection module control section 204 first closes all of the supply-side valves 68 and the discharge-side valves 72 and also closes the supply-side branching path valve 44 and the discharge-side branching path valve 45.

The ejection module control section 204 opens the first circulation valve 84 and also opens the supply-side valves 68 and the discharge-side valves 72 of the ejection modules 50 that are objects of maintenance. As in the case of the ink supply mechanism 39, pressurizing operation or suction operation is performed.

As in the case of the ink supply mechanism 39, during image recording operation, pressure fluctuations in ink of the supply-side manifold 58 and the discharge-side manifold 64 are lessened even in the ink supply mechanism 391 through foregoing operation. During maintenance operation, required pressure is imparted to the ink without being attenuated.

During air bubble recovery operation, the ejection module control section 204 opens the first circulation valve 84, and closes all of the other valves (the supply-side valves 68, the discharge-side valves 72, the supply-side branching path valve 44, and the discharge-side branching path valve 45). Next, the pump control section 212 activates the supply-side pump 138 and the discharge-side pump 178, thereby generating the pressure used for circulating ink.

(A Configuration of the Buffer Unit 42)

An example configuration of each of the buffers 42 of the ink supply mechanism 391 is now described.

Figure 6A:
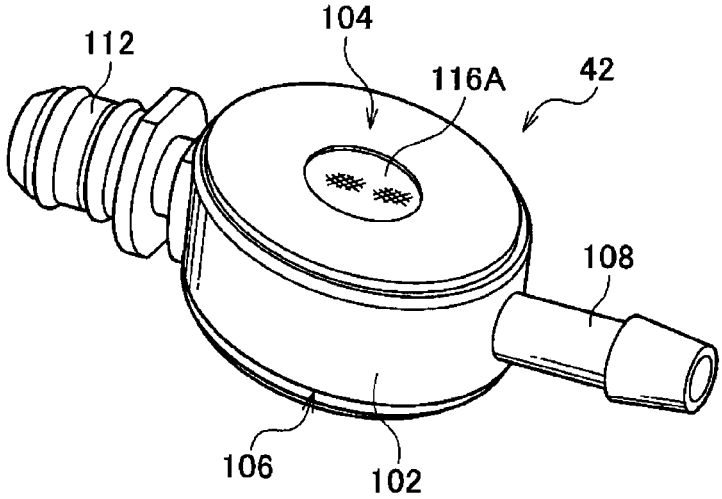
FIG. 6A is an oblique perspective view of a buffer of the ink supply mechanism of the first example modification.
Figure 6B:
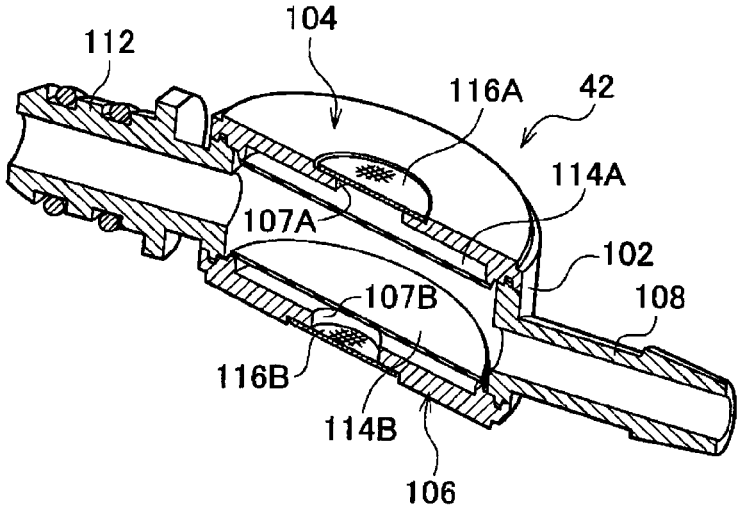
FIG. 6B is a cross sectional view of the buffer.

As shown in FIGS. 6A and 6B, each of the buffers 42 has a main body 102 formed from a sidewall, or a cylindrical body, that is made in an oval shape when viewed from above; and an upper cover 104 and a lower cover 106 that are example walls for closing openings on both sides of the main body 102.

A cylindrical connection section 108 projecting outside from one end of the oval along its long axis is formed in the main body 102. Further, a cylindrical connection section 112 projecting outside from the other end of the oval along its long axis is formed in the main body 102. An interior of the connection section 108 and an interior of the connection section 112 are in mutual communication with an interior of the main body 102. The connection section 108 and the connection section 112 are connected to the second circulation path 82.

Figure 7A:
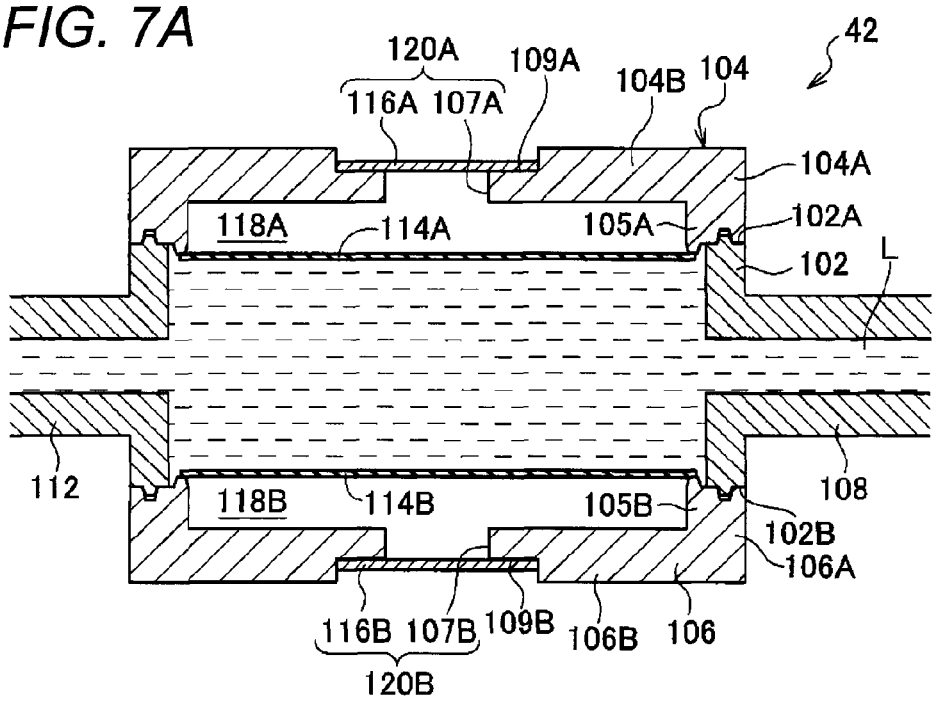
FIGS. 7A and 7B are cross sectional views showing operation of the buffer shown in FIGS. 6A and 6B.

As shown in FIG. 7A, the upper cover 104 is built from a sidewall 104A provided upright on an upper opening edge 102A of the main body 102 and a top wall 104B extending from an upper end of the sidewall 104A toward the inside of the main body 102 along a horizontal direction. An annular support 105A projecting inside than is an inner peripheral surface of the main body 102 is formed along an inner peripheral surface of the sidewall 104A. An outer edge of an elastic membrane 114A that is oval when viewed from above is attached to a lower end of the annular support 105A by means of ultrasonic welding.

A pored wall 107A serving as an example penetrated pore section is formed in a center of the top wall 104B when viewed from above, and a step 109A indented toward the elastic membrane 114A is formed along an edge of the upper end of the pored wall 107A. A gas-liquid separation membrane 116A that seals the pored wall 107A and that allows passage of air (gas) but blocks passage of ink (liquid) is attached to the step 109A by means of heat welding. The pored wall 107A and the gas-liquid separation membrane 116A make up a resistance section 120A serving as an example of a resistance section.

The elastic membrane 114A forms a wall of the second circulation path 82 and prevents outflow of ink L from the interior of the main body 102 to the outside. The upper cover 104 is disposed outside the main body 102, thereby forming an air chamber 118A serving as an example gas chamber between the upper cover 104 and the elastic membrane 114A. Namely, the air chamber 118A is provided between the elastic membrane 114A and the gas-liquid separation membrane 116A.

Likewise, the lower cover 106 includes a sidewall 106A provided on an underside of a lower opening edge 102B of the main body 102 and a bottom wall 106B extending from a lower end of the sidewall 106A toward the inside of the main body 102 along the horizontal direction. A support 105B is formed on the inner peripheral surface of the sidewall 106A so as to project to an interior than to the inner peripheral surface of the main body 102. An outer edge of an elastic membrane 114B that is oval when viewed from above is attached to an upper end of the support 105B by means of bonding.

A pored wall 107B serving as an example penetrated pore section is formed in a center of the bottom wall 106B when viewed from above, and a step 109B indented toward the elastic membrane 114B is formed along an edge of the lower end of the pored wall 107B. A gas-liquid separation membrane 116B that seals the pored wall 107B and that allows passage of air (gas) but blocks passage of ink (liquid) is attached to the step 109B. The pored wall 107B and the gas-liquid separation membrane 116B make up a resistance section 120B serving as an example of a resistance section.

The elastic membrane 114B forms a wall of the second circulation path 82 and prevents outflow of ink L from the interior of the main body 102 to the outside. The lower cover 106 is disposed outside the main body 102, thereby forming an air chamber 118B serving as an example gas chamber between the lower cover 106 and the elastic membrane 114B. Namely, the air chamber 118B is provided between the elastic membrane 114B and the gas-liquid separation membrane 116B.

In each of the buffers 42, the upper cover 104 and the lower cover 106 are formed from the same material and into the same shape and size. The elastic membrane 114A and the elastic membrane 114B are also formed from the same material and into the same shape and size. Further, the gas-liquid separation membrane 116A and the gas-liquid separation membrane 116B are formed from the same material and into the same shape and size. Further, the pored wall 107A and the pored wall 107B have the same inner diameter. Specifically, each of the buffers 42 has a structure that is symmetrical along the vertical direction about the flow path of the ink L. Further, the gas-liquid separation membranes 116A and 116B are membranes that become less deformed than are the elastic membranes 114A and 114B.

Figure 7B:
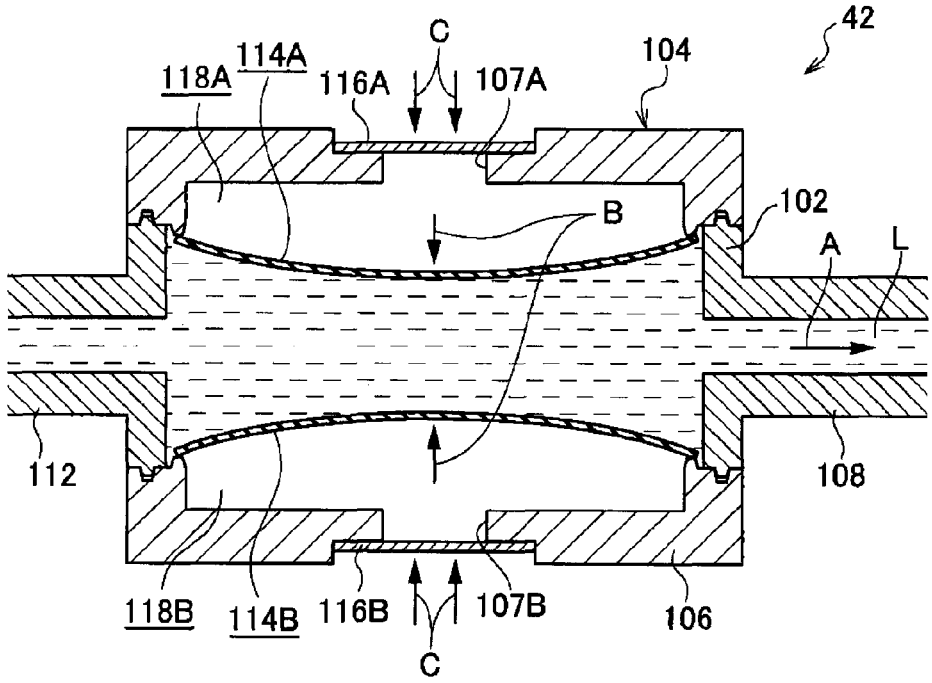

As shown in FIG. 7B, when negative pressure is exerted on the ink L flowing in arrowy direction A in each of the buffers 42, the elastic membranes 114A and 114B become inwardly deformed (i.e., in arrowy direction B), whereby the volume of the flow path of the ink L is decreased to lessen (absorb) pressure fluctuations. Further, although unillustrated, the elastic membranes 114A and 114B expand outside (in a direction opposite to the arrowy direction B) in the case of positive pressure, thereby increasing the volume of the flow path of the ink L to lessen (absorb) pressure fluctuations.

Second Example Modification

An ink supply mechanism 392 of a second example modification is now described. An explanation is now given to a difference between the ink supply mechanisms 391 and 392.

Figure 8:
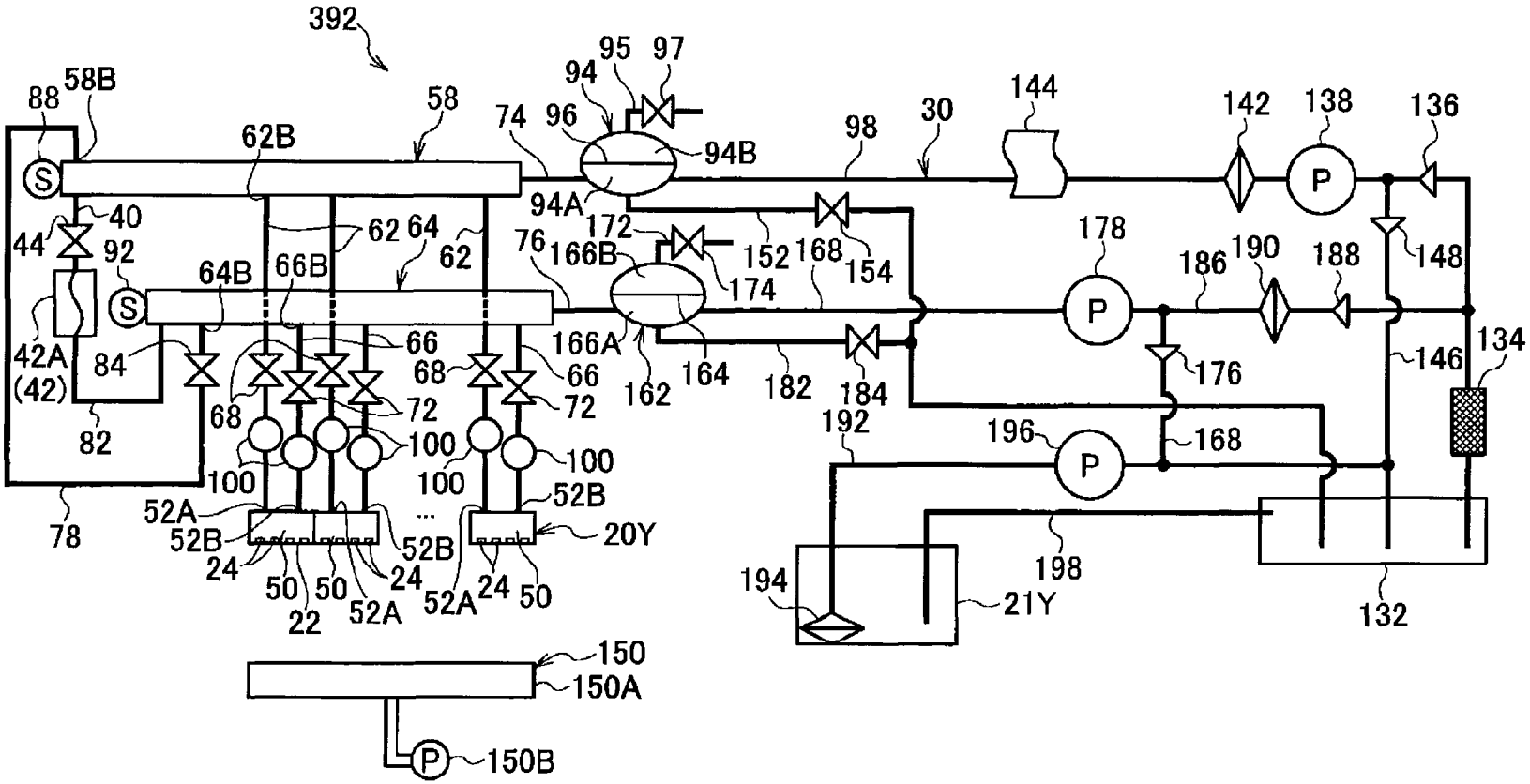
FIG. 8 is a schematic view showing a configuration of an ink supply mechanism of a second example modification.

As shown in FIG. 8, when compared with the ink supply mechanism 391, the ink supply mechanism 392 is configured so as not to include the buffer unit 42B and the discharge-side branching path valve 45.

In the ink supply mechanism 392, the pump control section 212 activates the supply-side pump 138 and the discharge-side pump 178 during the image recording operation for recording an image on the recording medium P, thereby generating pressure used for circulating ink. The ejection module control section 204 at this time opens all of the supply-side valves 68 and the discharge-side valves 72; opens the supply-side branching path valve 44; and closes the first circulation valve 84.

During the pressure process maintenance operation, the ejection module control section 204 first closes all of the supply-side valves 68 and the discharge-side valves 72 and also closes the supply-side branching path valve 44 and the first circulation valve 84.

The pump control section 212 then activates the discharge-side pump 178, to thus pressurize the discharge-side manifold 64 to a predetermined pressure level (e.g., 30 to 50 kPa). The buffer unit 42 is also pressurized at this time, whereupon an internal volume of the buffer unit 42 is maximized, thereby preventing yielding of the lessening effect for lessening pressure fluctuations.

Next, the ejection module control section 204 opens the supply-side valves 68 of the ejection modules 50 that are objects of maintenance and the supply-side valves 68. Next, the first circulation valve 84 is opened, and the pump control section 212 activates the supply-side pump 138 and the discharge-side pump 178, thereby pressurizing the supply-side manifold 58 and the discharge-side manifold 64. Air bubbles (viscosity-enhanced ink) are thereby discharged along with ink from the ejection modules 50 through the discharge-side manifold 64, the first circulation path 78, the supply-side manifold 58, and the individual supply channels 62.

The pressurizing force generated by the supply-side pump 138 and the discharge-side pump 178 is lowered, thereby maintaining a state in which the internal pressure of the supply-side manifold 58 and the internal pressure of the discharge-side manifold 64 gradually decrease.

When discharging the air bubbles (the viscosity-enhanced ink) from the ejection modules 50 has completed, the pump control section 212 deactivates the supply-side pump 138 and the discharge-side pump 178, thereby closing the supply-side branching path valve 44 and the first circulation valve 84. Internal residual pressure of the supply-side manifold 58 is released through the supply-side sub-tank 94 and the drain pipe 152.

As in the case of the ink supply mechanism 39, the ink supply mechanism 392 also lessens pressure fluctuations in ink of the supply-side manifold 58 and the discharge-side manifold 64 through the foregoing operation during the image recording operation. During maintenance operation, required pressure is imparted to ink without being attenuated.

During air bubble recovery operation, the ejection module control section 204 opens the first circulation valve 84 and closes all of the other valves (the supply-side valves 68, the discharge-side valves 72, and the supply-side branching path valve 44). Next, the pump control section 212 activates the supply-side pump 138 and the discharge-side pump 178, thereby generating pressure used for circulating ink.

Third Example Modification

Figure 9:
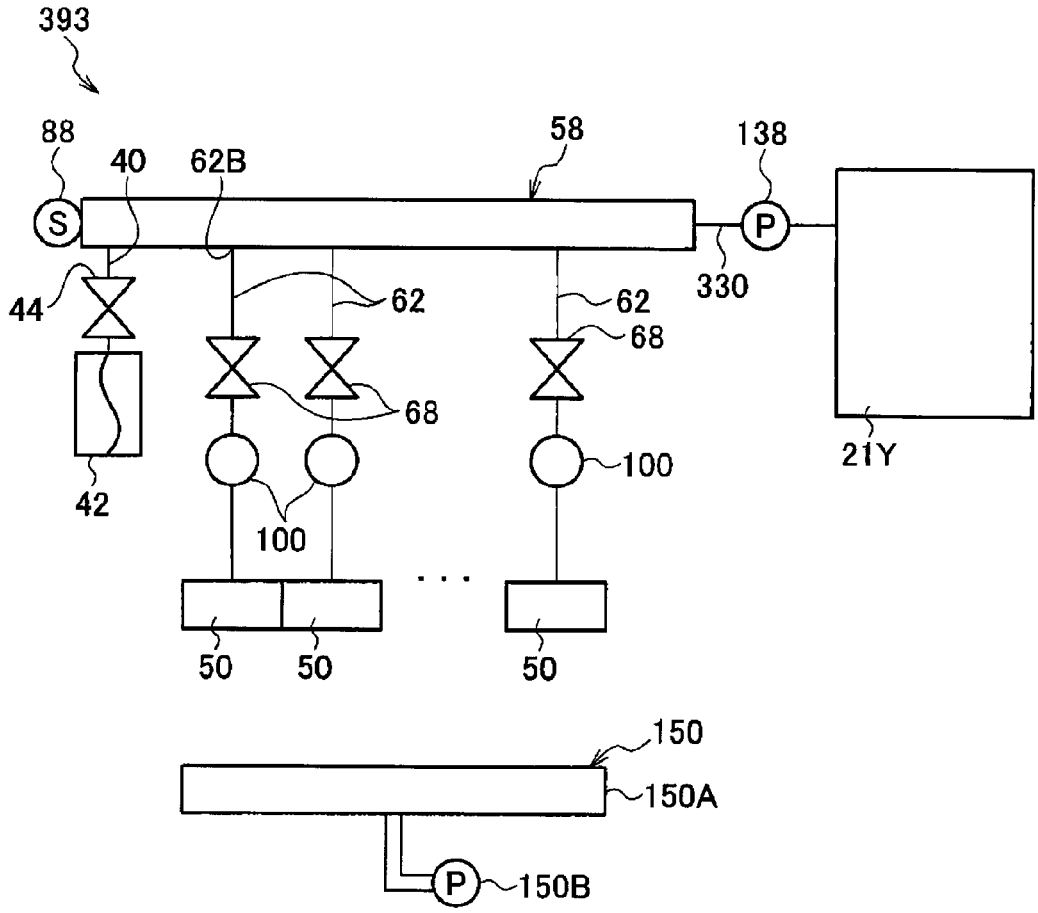
FIG. 9 is a schematic view showing a configuration of an ink supply mechanism of a third example modification.

An ink supply mechanism 393 of a third example modification is now described. As shown in FIG. 9, the ink supply mechanism 393 is configured so as not to have a discharge pathway, like the discharge pathway employed in the ink supply mechanism 39, and to circulate ink.

In the ink supply mechanism 393, the ink tank 21Y is in mutual communication with the supply-side manifold 58 through a flow path 330. The flow path 330 is provided with the supply-side pump 138 as a pressure control section. The pump is; for instance, a tube pump capable of precisely controlling a flow rate according to a value of the supply-side pressure sensor 88.

During the image recording operation for recording an image on the recording medium P, the ink supply mechanism 393 activates the supply-side pump 138, thereby generating pressure (negative pressure) used for supplying ink. All of the supply-side valves 68 are opened at this time, and the supply-side branching path valve 44 is opened.

During the pressure process maintenance operation, all of the supply-side valves 68 are closed, and the supply-side branching path valve 44 is closed. The supply-side pump 138 is then activated, and the supply-side manifold 58 is pressurized to a predetermined pressure level (e.g., 30 to 50 kPa).

Next, the supply-side valves 68 of the ejection modules 50 that are objects of maintenance are opened. Air bubbles are thereby discharged from the ejection modules 50 along with ink. After discharging air bubbles (viscosity-enhanced ink) from the ejection modules 50 has completed, the supply-side pump 138 is returned to a supply pressure level for image recording purpose, and the supply-side branching path valve 44 is opened.

During the suction process maintenance operation, after the supply-side branching path valve 44 has been closed, the nozzles 24 (the nozzle surfaces) of the ejection modules 50 are covered with the cap 150A, and the interior of the cap 150A is depressurized by means of the suction device 150B within a predetermined period of time. The cap 150A can also be configured so as to individually cover each of the ejection modules 50 or collectively cover the plurality of ejection modules 50.

By means of the foregoing operations, the ink supply mechanism 393 also lessens pressure fluctuations in ink of the supply-side manifold 58 during image recording operation, as in the case of the ink supply mechanism 39. During maintenance operation, required pressure is imparted to ink without being attenuated.

Control of supply pressure used for supplying ink to the respective ejection modules 50 may also be implemented by use of a water head difference or pneumatic pressure or by any technique.

Fourth Example Modification

Figure 10:
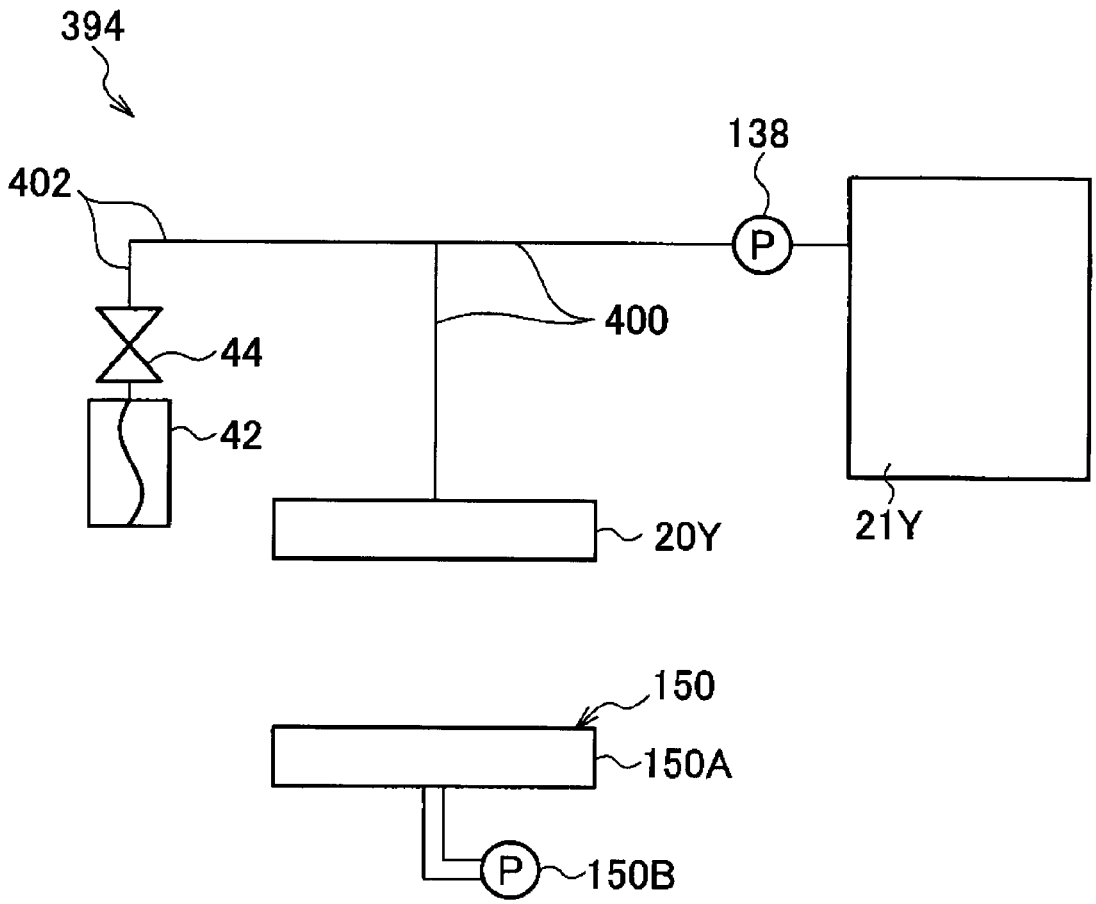
FIG. 10 is a schematic view showing a configuration of an ink supply mechanism of a fourth example modification.

An ink supply mechanism 394 of a fourth example modification is now described. As shown in FIG. 10, the ink supply mechanism 394 is configured not to include the common supply pathway. In this configuration, the inkjet recording head 20Y is built from a single head, and the ink tank 21Y is in mutual communication with the inkjet recording head 20Y by means of a supply pathway 400. The supply pathway 400 is provided with the supply-side pump 138 as a pressure section. A branching path 402 branched off from the supply pathway 400 is provided with the supply-side branching path valve 44 and the buffer unit 42.

Even in this configuration, the supply-side branching path valve 44 is opened as mentioned above during the image recording operation for recording an image on the recording medium P. During the pressure process maintenance operation and the suction process maintenance, the supply-side branching path valve 44 is closed, to thus perform pressurizing operation or suction operation.

As in the case of the ink supply mechanism 39, the ink supply mechanism 394 also lessens pressure fluctuations in ink of the supply-side manifold 58 through the foregoing operation during image recording operation. During maintenance operation, required pressure is imparted to ink without being attenuated.

The present invention is not confined to the embodiment and is susceptible to various modifications, alterations, or improvements. For instance, some of the above-mentioned example modifications can also be configured in combination as required.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid supply mechanism comprising:

a tank that reserves liquid;

a supply pathway to which the liquid is supplied, the supply pathway supplying the liquid to a plurality of ejection sections each ejecting the liquid from nozzles;

a branching path that is branched off from the supply pathway and through which the liquid circulates;

a buffer unit that is disposed in the branching path and that lessens pressure fluctuations occurred in the liquid in the branching path; and a changing unit that changes a pathway to the buffer unit so that the changing unit shuts the pathway to the buffer unit during maintenance for discharging the liquid from the nozzles of the ejection sections, wherein the liquid discharged during the maintenance is greater in quantity than the liquid discharged during normal operation.

2. The liquid supply mechanism according to claim 1, wherein the supply pathway includes:

a plurality of individual supply pathways that are connected to the plurality of ejection sections and that supply the liquid to the respective ejection sections; and a common supply pathway that supplies the liquid to the plurality of individual supply pathways, and the buffer unit is disposed in the branching path branched off from the common supply pathway.

3. The liquid supply mechanism according to claim 2, wherein the branching path is branched off from the common supply pathway at a more downstream position than a connection section of the common supply pathway for one of the individual supply pathways that is connected at a most downstream position among the individual supply pathways in a direction of circulation of liquid of the common supply pathway.

4. The liquid supply mechanism according to claim 1, wherein the changing unit is a valve provided in the branching path, in the normal operation, the liquid is discharged from the nozzles of the ejection sections with the valve being open, in the maintenance, the liquid is discharged from the nozzles of the ejection sections with the valve being closed, and the liquid discharged from the nozzles during the maintenance is greater in quantity than the liquid discharged during normal operation.

5. The liquid supply mechanism according to claim 4, wherein the branching path is branched off from the common supply pathway at a more downstream position than a connection section of the common supply pathway for one of the individual supply pathways that is connected at a most downstream position among the individual supply pathways in a direction of circulation of liquid of the common supply pathway.

6. An image forming apparatus comprising:

the liquid supply mechanism according to claim 1; and the ejection sections that eject liquid droplets to a recoding medium so as to forming an image on the recording medium.

7. A liquid supply mechanism comprising:

a tank that reserves liquid;

individual supply pathways that are connected to a plurality of ejection sections ejecting the liquid from nozzles and that supply the liquid to the respective ejection sections;

a common supply pathway to which the liquid is supplied, the common supply pathway supplying the liquid to the individual supply pathways;

individual discharge pathways that are connected to the plurality of ejection sections and through which the respective ejection sections discharge the liquid supplied from the individual supply pathways;

a common discharge pathway to which the individual discharge pathways discharge the liquid;

a branching path that is branched off at least from the common supply pathway or the common discharge pathway and through which the liquid circulates;

a buffer unit that is disposed in the branching path and that lessens pressure fluctuations occurred in the liquid in the branching path; and a changing unit that changes a pathway to the buffer unit so that the changing unit shuts the pathway to the buffer unit during maintenance for discharging the liquid from the nozzles of the ejection section, wherein the liquid discharged during the maintenance is greater in quantity than the liquid discharged during normal operation.

8. The liquid supply mechanism according to claim 7, further comprising:

a first circulation path that circulates the liquid between the common supply pathway and the common discharge pathway; and a second circulation path that serves as the branching path which circulates the liquid between the common supply pathway and the common discharge pathway.

9. The liquid supply mechanism according to claim 8, wherein the changing unit is a valve provided in the second circulation path which serves as the branching path, in the normal operation, the liquid is discharged from the nozzles of the ejection sections with the second circulation path being open by opening the valve and the first circulation path being closed, in the maintenance, the liquid is discharged from the nozzles of the ejection sections with the second circulation path being closed by closing the valve and the first circulation path being open, and the liquid discharged from the nozzles during the maintenance is greater in quantity than the liquid discharged during normal operation.

10. The liquid supply mechanism according to claim 7, wherein the branching path is branched off from the common discharge pathway at a more upstream position than a connection section of the common discharge pathway for one of the individual discharge pathways that is connected at a most downstream position among the individual discharge pathways in a direction of circulation of liquid of the common discharge pathway.

* * * * *